US012054686B1

(12) United States Patent
Abdeen

(10) Patent No.: US 12,054,686 B1
(45) Date of Patent: Aug. 6, 2024

(54) NATURAL FUEL ADDITIVE AND PREMIUM FUEL COMPRISING THE SAME

(71) Applicant: GREEN PETROSOL LTD., Rolling Hills Estates, CA (US)

(72) Inventor: Ziad Abdul Mohsen Hussein Abdeen, Jerusalem (IL)

(73) Assignee: GREEN PETROSOL LTD., Rolling Hills Estates, CA (US)

( * ) Notice: Subject to any disclaimer, the term of this patent is extended or adjusted under 35 U.S.C. 154(b) by 0 days.

(21) Appl. No.: 18/484,133

(22) Filed: Oct. 10, 2023

Related U.S. Application Data

(60) Provisional application No. 63/440,008, filed on Jan. 19, 2023.

(51) Int. Cl.

| | |
|---|---|
| ***C10L 10/02*** | (2006.01) |
| ***C10L 1/12*** | (2006.01) |
| ***C10L 1/18*** | (2006.01) |
| ***C10L 1/182*** | (2006.01) |

(52) U.S. Cl.
CPC ..... *C10L 10/02* (2013.01); *C10L 1/125* (2013.01); *C10L 1/1283* (2013.01); *C10L 1/1802* (2013.01); *C10L 1/182* (2013.01); *C10L 2200/029* (2013.01); *C10L 2200/0469* (2013.01); *C10L 2230/22* (2013.01); *C10L 2270/023* (2013.01); *C10L 2270/026* (2013.01); *C10L 2270/04* (2013.01)

(58) Field of Classification Search
CPC ..... C10L 10/02; C10L 1/125; C10L 1/1283; C10L 1/1802; C10L 1/182; C10L 2200/029; C10L 2200/0469; C10L 2230/22; C10L 2270/023; C10L 2270/026; C10L 2270/04
See application file for complete search history.

(56) References Cited

U.S. PATENT DOCUMENTS

2013/0164798 A1* 6/2013 Vanhercke ..... C10G 2/00 44/605
2015/0099681 A1* 4/2015 Rehage ..... C10G 1/045 208/390

OTHER PUBLICATIONS

An International Search Report and a Written Opinion both dated Mar. 5, 2024, which issued during the prosecution of Applicant's PCT/IL2024/050079.

* cited by examiner

*Primary Examiner* — Ellen M McAvoy
*Assistant Examiner* — Chantel Graham
(74) *Attorney, Agent, or Firm* — Sughrue Mion, PLLC

(57) ABSTRACT

An additive composition for liquid fuels is provided. The additive composition comprises water, one or more mineral salts, a polyol compound, an alcohol and a surfactant. The additive composition can be added to liquid fuels such as gasoline, diesel, kerosene and mazut to improve fuel efficiency and reduce emissions. The composition can be prepared from all natural materials.

35 Claims, No Drawings

NATURAL FUEL ADDITIVE AND PREMIUM FUEL COMPRISING THE SAME

CROSS-REFERENCE TO RELATED APPLICATIONS

Reference is made to U.S. Provisional Patent Application Ser. No. 63/440,008, filed Jan. 19, 2023 and entitled NATURAL FUEL ADDITIVE AND PREMIUM FUEL COMPRISING THE SAME, the disclosure of which is hereby incorporated by reference and priority of which is hereby claimed pursuant to 37 CFR 1.78(a)(4) and (5)(i).

FIELD OF THE INVENTION

The present invention relates to a fuel additive made from natural materials, a method for producing it and a premium fuel comprising it.

BACKGROUND OF THE INVENTION

Various additives are known for improving properties of liquid fuels.

SUMMARY OF THE INVENTION

The present invention seeks to provide a natural fuel additive, a method for producing it and a premium fuel comprising it.

There is thus provided in accordance with a preferred embodiment of the present invention a composition including: water, one or more mineral salts, a polyol compound, an alcohol and a surfactant. Preferably, the water is demineralized water, more preferably the water is double distilled water.

In accordance with one preferred embodiment of the present invention, the one or more mineral salts are selected from the group consisting of phosphate salts and alums. Preferably, the phosphate salts are selected from the group consisting of sodium phosphates, potassium phosphates, ammonium phosphates, calcium phosphates and magnesium phosphates, and the alums are selected from the group consisting of sodium alum, potassium alum and ammonium alum. The one or more mineral salts is preferably potassium alum or ammonium alum. In one preferred embodiment, the concentration of the one or more mineral salts in the composition is from about 0.5% w/w to about 5% w/w, more preferably from about 2% w/w to about 2.5% w/w.

Preferably, the polyol compound is selected from the group consisting of glycols, such as ethylene glycol and propylene glycol, and glycerol, most preferably glycerol. In one preferred embodiment, the concentration of the polyol compound in the composition is from about 30% w/w to about 50% w/w, more preferably about 40% w/w to about 50% w/w, most preferably about 45% w/w.

In accordance with one preferred embodiment of the present invention, the alcohol is a $C_1$-$C_5$ alcohol, more preferably a $C_1$-$C_3$ alcohol, most preferably propan-2-ol. Preferably, the concentration of the alcohol in the composition is from about 5% w/w to about 15% w/w, more preferably about 10% w/w.

In accordance with another preferred embodiment of the present invention, the surfactant is selected from the group consisting of alkyl glycosides and polysorbates. Preferably, the alkyl glycosides are selected from the group consisting of decyl glycoside, lauryl glycoside and coco glycoside, and the polysorbates are selected from the group consisting of polysorbate 20, polysorbate 40, polysorbate 60 and polysorbate 80. Most preferably, the surfactant is polysorbate 80. In one preferred embodiment, the concentration of the surfactant in the composition is from about 0.5% w/w to about 1.2% w/w, more preferably about 1% w/w.

Preferably, the composition further includes an agent for reducing formation of sludge, preferably methyl oleate. In one preferred embodiment, the concentration of the methyl oleate in the composition is from about 1% w/w to about 5% w/w.

There is also provided in accordance with another preferred embodiment of the present invention a method of preparing a composition useful as a fuel additive, the method including: adding one or more mineral salts to water, heating the water with stirring until the mineral salts dissolve to form a solution, removing the heating and adding a polyol compound with stirring to the warm solution, adding an alcohol to the solution with stirring, adding a surfactant to the solution with stirring, and allowing the solution to cool to room temperature. Preferably, the water is heated to a temperature of about 50° C. to about 80° C., more preferably about 60° C. to about 70° C.

There is also provided in accordance with an additional preferred embodiment of the present invention a blended fuel comprising: a liquid fuel and a composition as described above. Preferably, the liquid fuel is selected from the group consisting of gasoline, diesel, kerosene and mazut. In one preferred embodiment, the composition is added to the liquid fuel at a concentration of about 0.1% to about 0.2% w/w, more preferably about 0.1% to about 0.15% w/w.

DETAILED DESCRIPTION OF THE INVENTION

Combustion of liquid fuels in the internal combustion engines of vehicles or in boilers leads to emission of undesirable substances including carbon monoxide, carbon dioxide, nitrous oxides (NOx), unburned hydrocarbons and particulate matter. These substances have a negative effect oi the environment and on human health.

It is known that introducing oxygenated compounds in fossil fuels helps to improve combustion and reduce the emission of toxic compounds. In U.S. Pat. No. 3,877,450, oxygen is utilized to augment the normal air supply and thereby promote complete fuel combustion. Separate oxygen conduits are connected to each cylinder. In U.S. Pat. No. 3,961,609, pure oxygen is passed from a tank in which it is stored to the air intake means of the engine. Nitrogen oxide has also been used as an oxygen substitute. While these methods may improve performance, they require additional equipment in the engine, adding cost and weight.

Adding water to a liquid fuel can also improve the performance of internal combustion engines. Addition of water increases the octane number of gasoline and reduces environmental damage resulting from combustion of organic fuel. U.S. Pat. No. 4,611,557 discloses dispersing water in fuel using a dispersing means as part of the engine. The required structural change to the engine renders this solution impractical. U.S. Pat. No. 5,156,114 discloses a fuel comprising water from about 20 percent to about 80 percent by volume of the total volume of said fuel and a carbonaceous fuel. A hydrogen producing catalyst must be installed in the engine. This and other structural changes to the engine make also this solution impractical.

U.S. Pat. No. 6,533,829 discloses an additive for stabilizing a water-containing liquid hydrocarbon fuel, which additive comprises an alcohol of 5-10 carbon atoms, a carboxylic amide of 5-10 carbon atoms, a carboxylic acid of 5-10 carbon atoms. The additive is added to the fuel at between 5-15% by weight of the liquid fuel. The high concentration of the additive significantly increases the cost of the fuel.

U.S. Pat. No. 4,045,188 discloses ditertiarybutyl peroxide contained in a lower melting solvent as an additive which provides some improvement in fuel economy. U.S. Pat. No. 4,298,351 discloses using a composition consisting of methanol a tertiary alkyl peroxide as a gasoline substitute as well as in mixture with conventional gasolines. EP 0255115 discloses a gasoline additive composition consisting of an organic peroxide and a gasoline detergent selected from among amines, diamines, polymeric amines with carboxylic acids in a hydrocarbon solvent.

What is needed is a composition that can be added to conventional fuels to be used in a standard engine or boiler, which composition improves combustion and reduces fuel consumption and emissions. The composition would ideally be made from natural components.

In accordance with a first embodiment of the present invention, there is provided a fuel additive composition comprising: water, one or more mineral salts, a polyol compound, an alcohol, and a surfactant. Preferably, all of the components of the composition are derived from natural sources.

The water in the composition can be any water, including municipal drinking water. However, it is preferable to use demineralized or distilled water. Double-distilled or triple-distilled water can be used in the composition. In a preferred embodiment, the water is double-distilled water. The water preferably comprises about 40% w/w to about 45% w/w of the composition.

The polyol compound is preferably selected from a glycol and glycerol. The glycol is preferably ethylene glycol or propylene glycol, most preferably ethylene glycol. In a preferred embodiment, the polyol compound is glycerol. The glycerol is preferably derived from a vegetable source, such as soy or canola. The polyol compound preferably has a high grade of purity, such as >99%. The polyol compound preferably comprises about 30% to about 50% w/w of the composition, more preferably about 40% to about 50% w/w. In a preferred embodiment, the polyol compound comprises about 45% w/w of the composition.

The alcohol is preferably a $C_1$-$C_8$ alcohol, more preferably a $C_1$-$C_5$ alcohol, and most preferably a $C_1$-$C_3$ alcohol. In a preferred embodiment, the alcohol is propan-2-ol. The alcohol preferably has a high grade of purity, such as >99%. The alcohol preferably comprises about 5% to about 15% w/w of the composition. In a preferred embodiment, the alcohol comprises about 10% w/w of the composition.

The surfactant is preferably any surfactant produced from natural substances. For example, the surfactant can be an alkyl glycoside, such as decyl glycoside, lauryl glycoside and coco glycoside, or a polysorbate surfactant, such as polyoxyethylene (20) sorbitan monolaurate, polyoxyethylene (20) sorbitan monopalmitate, polyoxyethylene (20) sorbitan monostearate and polyoxyethylene (20) sorbitan monooleate. In a preferred embodiment, the surfactant is polyoxyethylene (20) sorbitan monooleate (Tween 80). The surfactant preferably comprises about 0.5% to about 1.2% w/w of the composition. In a preferred embodiment, the surfactant comprises about 1% w/w of the composition.

The mineral salt can be any mineral salt, but is preferably selected from phosphates, such as sodium phosphates, potassium phosphates, ammonium phosphates, calcium phosphates and magnesium phosphates, and alums, such as sodium alum, potassium alum and ammonium alum. Most preferably, the mineral salt is potassium alum (potassium aluminum sulfate dodecahydrate [$KAl(SO_4)_2 \cdot 12H_2O$]) or ammonium alum (ammonium aluminum sulfate dodecahydrate [$(NH_4)Al(SO_4)_2 \cdot 12H_2O$]). The mineral salt is preferably added to the water used to prepare the composition at a concentration of about 1% to about 10% w/w of the water. In a preferred embodiment, the mineral salt is added to the water at a concentration of about 5% w/w of the water.

The composition may include additional components. For example, the composition may include a compound that prevents formation of sludge when the composition is added to the fuel. A preferred compound is methyl oleate. The methyl oleate preferably has a high grade of purity, such as >99%. The methyl oleate, when present, preferably comprises about 1% to about 5% w/w of the composition.

The composition is preferably prepared by adding the mineral salt to the water and heating the water with stirring. The water is preferably heated to a temperature from about 50° C. to about 80° C. More preferably, the water is heated to a temperature from about 60° C. to about 70° C. Once the salt is dissolved, the heating is ceased, and the polyol compound is added to the warm salt solution. The solution is stirred for about 5-10 minutes and then the alcohol compound is added. The solution is stirred for an additional 5-10 minutes and then the surfactant is added. After stirring for an additional 5-10 minutes, the solution is allowed to cool to room temperature and then stored for use.

The composition is useful as an additive to a liquid fuel. As used in this specification the term "liquid fuel" means not only any hydrocarbon mixture for internal combustion engines but any burnable liquid matter such as crude oil, distillate from slate, and the like. Preferred liquid fuels for use with the composition of the present invention include gasoline, diesel, kerosene and mazut. The composition is added to the fuel at a concentration of about 0.1% to about 0.2% w/w. In a preferred embodiment, the composition is added to the fuel at a concentration of about 0.1% w/w or about 0.15% w/w.

One method of blending the composition with the fuel is to mix with a rotary mixer. The mixing may take place at about 50 rpm for 2 to 10 hours, preferably about 6 hours. The blended fuel is preferably left to sit overnight and filtered to remove any precipitation. Filtration may be achieved by passing though cotton, filter paper or a sieve, such as a 40-micron sieve.

Another method is mixing under high pressure. The composition and additive may be mixed at about 100 to about 300 bar for 1 to 15 minutes. Fuel blending by this method leads to formation of sludge which contains particles over a significant size range, i.e., they are hetero-dispersed. Bottom sedimentation of impurities such as organic acid, colloids and asphaltic substances in the blended fuel leads to an increase in viscosity which will ultimately affect the combustion process performance. Therefore, filtration is needed to obtain premium fuel. The process of sludge/bottom sedimentation separation can be achieved by filtration through a filter, such as a 40-micron sieve.

EXAMPLES

Example 1—Preparation of Additive Composition 50 g of potassium aluminum sulfate dodecahydrate (potassium alum) (Muby Chemicals, Mumbai, India, Reagent Grade 99.5% pure) were added to 1 kg double distilled water, and the solution was heated to 70° C. with stirring.

450 g of the hot solution were mixed with 450 g all-natural, food grade glycerol (ChemWorld, Kennesaw, GA, USA) and stirred for 10 minutes without heating. 100 g propan-2-ol (Tengyu New Material Technology Co., Ltd., Luoshe, China, 99.9% pure) were added, and the solution was stirred for an additional 10 minutes without heating. 10 g pure polysorbate 80 (Crescent Chemical Co., Ltd., Islandia, NY, USA) were added, and the solution was stirred for an additional 5 minutes without heating. The resulting solution was allowed to cool to room temperature and stored in a plastic bottle.

Example 2—Emissions Test

Two cars, a 13-year-old Citroen running on gasoline, and an 11-year-old Ford Transit running on diesel were taken to an emissions test at an Israel Motor Vehicle Registry approved testing site (Dynamometer, Jerusalem, Israel). Following the test, a container containing the additive composition prepared in Example 1 was installed in the gasoline vehicle between the gas tank and the engine, and in the diesel vehicle between the gas tank and the injection pump. The cars were then driven for 30 minutes and returned to the emissions test. The gasoline vehicle was driven for an additional 14 days and the diesel vehicle was driven for an additional day and returned to the emissions test.

The major component of gasoline emissions which is tested is carbon monoxide (CO). The requirement is that the volume percent of CO be less than 0.5% when the engine is idle and less than 0.3% when the engine is running at 2500-3000 rpm. In diesel vehicles, the component which is tested is the black smoke absorption coefficient K. The requirement is that K be less than 2.0. The results are set forth in Tables 1 and 2 below.

TABLE 1

Gasoline vehicle emissions test

| Time of test | Test mode | CO Volume % |
|---|---|---|
| Prior to installation | 800 rpm (idle) | 0.05% |
| | 2500 rpm | 0.12% |
| 30 min. driving after installation | 800 rpm (idle) | 0.01% |
| | 2500 rpm | 0.01% |
| 14 days driving after installation | 800 rpm (idle) | 0.00% |
| | 2500 rpm | 0.00% |

TABLE 2

Diesel vehicle emissions test

| Time of test | Black smoke absorption coefficient (K) |
|---|---|
| Prior to installation | 27.4 |
| 30 min. driving after installation | 1.1 |
| 1 day driving after installation | 0.4 |

In the gasoline vehicle, after 30 minutes of driving with the composition of Example 1, CO emissions decreased by 80% in idle mode and by 92% at high rpm. After 14 days of driving, the CO emissions dropped below the detection limit. In the diesel vehicle, after 30 minutes of driving the smoke absorption coefficient decreased by 96%, and after one day of driving decreased by over 98%. The composition of the present invention significantly decreases emissions in gasoline and diesel vehicles.

Example 3—Fuel Economy and Emissions

A 21-year-old GAZelle vehicle running on gasoline was driven 100 km with conventional fuel noting the fuel consumption followed by an emissions test. A premium fuel was prepared by adding the composition of Example 1 to the conventional fuel at a concentration of 0.15% w/w and mixing with a rotary mixer for six hours. The enhanced fuel was allowed to sit overnight, and filtered to remove sludge. The vehicle was refueled with the enhanced fuel and driven an additional 100 km. The fuel consumption was noted, and an emissions test was performed. The next day, the vehicle was driven 200 km, with an emissions test performed at the beginning, middle and end of the trip. The results are shown in Table 3.

TABLE 3

Fuel economy and emissions test

| Test | Fuel consumption (L/100 km) | CO vol. % | $CO_2$ vol. % | Hydrocarbons (ppm) | $O_2$, vol. % |
|---|---|---|---|---|---|
| Conventional fuel | 25 | 3.67 | 6.81 | 2676 | 20.8 |
| With additive-Day 1 | 20 | 0.20 | 0.39 | 61 | 20.8 |
| With additive-Day 2, 5 km | — | 2.69 | 5.69 | 2056 | 20.6 |
| With additive-Day 2, 100 km | 20 | 0.25 | 0.41 | 78 | 20.6 |
| With additive-Day 2, 200 km | 20 | 0.03 | 0.02 | 12 | 20.6 |

The additive composition improved the fuel economy by 20%. CO emissions improved by 94% on Day 1 and 99% on Day 2. $CO_2$ emissions improved by 94% on Day 1 and 99.7% on Day 2. Hydrocarbon emissions decreased by 97% on Day 1 and 99% on Day 2. The oxygen content was not affected. The composition of the present invention significantly decreases emissions and improves fuel economy.

Example 4—Fuel Economy Tests—Generators

An HP10 generator running on diesel and producing 7.5 kW was filled with conventional fuel to maximum capacity (12.5 L). The generator was connected to 4 kW heating plates and run continuously for 60 minutes. 1.4 L fuel had been used, showing the power produced was 2.86 kW/L. A blended fuel was prepared by mixing 0.1% w/w of the composition of Example 1 into the fuel with a rotary mixer for six hours. The generator tank was refilled with the blended fuel and again operated for 60 minutes. 1.1 L fuel had been consumed, showing the power produced was 3.64 kW/L. The fuel savings were 21.5%.

A KW500 generator running on diesel and producing 500 kW was filled with conventional fuel to maximum capacity (40 L). The generator was connected to a variable load between 57-142 kW (mostly at 90 kW) and run continuously for 60 minutes. The height of the fuel dropped 11.4 mm. The tank was refilled with the blended fuel, and the generator was again operated for 60 minutes. The height of the fuel dropped 9.1 mm. The fuel savings were 20.2%.

Example 5—Fuel Economy Tests—Vehicles

Various vehicles were driven between on trips of approximately 400 km using conventional fuel. After the first trip, the vehicles were refueled with a blended fuel prepared by mixing 0.1% w/w of the composition of Example 1 into the fuel with a rotary mixer for six hours. The fuel economy was measured for each trip. The results are summarized in Table 4.

TABLE 4

| Vehicle | Fuel type | Fuel economy (km/L) Without additive | With additive | Fuel savings (%) |
|---|---|---|---|---|
| Mazda 2 | Gasoline | 11.3 | $1^{st}$ trip: 13.3 | 15.0 |
| | | | $2^{nd}$ trip: 14.2 | 20.4 |
| | | | $3^{rd}$ trip: 14.9 | 24.2 |
| Chevrolet Malibu | Gasoline | 9.84 | 12.73 | 22.7 |
| Renault Kangoo | Diesel | 10.7 | 15.0 | 28.7 |
| Mazda 3 | Gasoline | 10.7 | 14.3 | 25.2 |

Example 6—Chemical Testing

Two samples were provided to the Chemical Testing Laboratory in Beit HaEmek, Israel. Sample 1 was a commercially available diesel fuel. Sample 2 was prepared by adding 0.15% w/w of the composition of Example 1 to the diesel fuel and pressurizing to 200 bar for five minutes. The sample was filtered through a 40-micron sieve to remove sludge. The test results are shown in Table 5. The results show that the fuel with the additive, which provides the advantages demonstrated in Examples 2-5, meets all of the Israeli standards for diesel fuel.

Example 7—Chemical Testing

Blended samples of gasoline and diesel fuel were prepared by adding 0.15% w/w of the composition of Example 1 to the fuels and mixing with a rotary mixer for 24 hours. The blended samples were filtered to remove sludge. The blended samples were provided together with reference samples with no additive to the Kuwait Institute for Scientific Research (Safat, Kuwait) for chemical testing. The test results are shown in Table 6. The blended samples meet all of the U.S. and European standards.

TABLE 5

| Test | Method | Sample 1 | Sample 2 | Units | Israel Standard 107 min | max |
|---|---|---|---|---|---|---|
| Sulfur | ASTM D-5453 | 4.7 | 4.4 | mg/kg | — | 10 |
| Distillation | ASTM D-86 | | | | | |
| IBP | | 174.8 | 176.4 | ° C. | — | — |
| 10% | | 210.7 | 214.4 | ° C. | — | — |
| 50% | | 279.2 | 280.5 | ° C. | — | — |
| 90% | | 338.9 | 338.7 | ° C. | — | — |
| 95% | | 352.7 | 351.3 | ° C. | — | 360 |
| FBP | | 359.9 | 361.6 | ° C. | — | — |
| 250° C. | | 29.7 | 28.5 | %(v/v) | — | 65 |
| 350° C. | | 94.1 | 94.5 | %/(v/v) | 85 | — |
| Ash Content | ASTM D-482 | <0.001 | <0.001 | %(m/m) | — | 0.01 |
| Density at 15° C. | ASTM D-1298 | 836.6 | 831.8 | mg/kg | 820 | 845 |
| FAME | EN 14078 | <0.2 | <0.02 | mg/kg | — | 5 |
| Water content | ASTM D-6304 | 56.90 | 58.44 | mg/kg | — | 200 |
| Total contamination | EN 12662 | 8 | 5 | mg/kg | — | 24 |
| Cold filter plugging point | IP 309 | −5 | −5 | ° C. | — | 5 |
| Viscosity 40° C. | ASTM D-445 | 3.130 | 3.138 | $mm^2/s$ | 2.00 | 4.5 |
| Oxidation stability | ASTM D-2274 | 10.3 | 2.9 | $mm^2/s$ | — | 12.0 |
| Copper corrosion | ASTM D-130 | 1A | 1A | $mm^2/s$ | — | 1 |
| Flash point | ASTM D-93/A | 74.0 | 74.0 | ° C. | 55.0 | — |
| Cetane index | ASTM D-4737 | 54.0 | 56.6 | — | 46.0 | — |
| Appearance | Visual | clear | clear | — | — | — |

TABLE 6

| Test | Method | Units | Gasoline Reference | Gasoline Blended | Diesel Reference | Diesel Blended |
|---|---|---|---|---|---|---|
| Water Content (KF) | ASTM D6304 | ppm | 185.6 | 152.2 | 64.61 | 56.96 |
| API | ASTM D4052 | — | 58.94 | 58.55 | 37.99 | 38 |
| SG | ASTM D4052 | — | 0.74302 | 0.74453 | 0.83485 | 0.83479 |
| Density @15° C. | ASTM D4052 | $g/cm^3$ | 0.74229 | 0.7438 | 0.83403 | 0.83397 |
| Density @20° C. | ASTM D4052 | $g/cm^3$ | 0.73774 | 0.73926 | 0.83046 | 0.83039 |
| Density @25° C. | ASTM D4052 | $g/cm^3$ | 0.73327 | 0.7348 | 0.82706 | 0.827 |
| Density @30° C. | ASTM D4052 | $g/cm^3$ | 0.72875 | 0.73029 | 0.82364 | 0.82357 |
| Density @40° C. | ASTM D4052 | $g/cm^3$ | 0.71962 | 0.72117 | 0.81679 | 0.81672 |
| Density @50° C. | ASTM D4052 | $g/cm^3$ | 0.71034 | 0.71192 | 0.80993 | 0.80986 |
| Density @60° C. | ASTM D4052 | $g/cm^3$ | 0.70091 | 0.70252 | 0.80305 | 0.80298 |
| Kin. Viscosity @20° C. | ASTM D445 | $mm^2/s$ | 0.564 | 0.568 | 6.237 | 6.219 |
| Kin. Viscosity @30° C. | ASTM D445 | $mm^2/s$ | 0.515 | 0.517 | 4.767 | 4.749 |
| Kin. Viscosity @40° C. | ASTM D445 | $mm^2/s$ | 0.484 | 0.477 | 3.754 | 3.777 |
| Kin. Viscosity @50° C. | ASTM D445 | $mm^2/s$ | 0.440 | 0.447 | 3.055 | 3.066 |
| Kin. Viscosity @60° C. | ASTM D445 | $mm^2/s$ | NA | NA | 2.540 | 2.540 |
| Flash Point | ASTM D93 | ° C. | NA | NA | 103.0 | 99.0 |
| Pour Point | ASTM D5949 | ° C. | NA | NA | −3.0 | −3.0 |
| Cloud Point | ASTM D5773 | ° C. | NA | NA | −4.3 | −4.2 |
| Freezing Point | ASTM D5972 | ° C. | NA | NA | −0.4 | −0.8 |
| Aniline Point | ASTM D611 | ° C. | NA | NA | 75.6 | 79.2 |
| Cetane Index | ASTM D4737 | — | NA | NA | 60.9 | 60.5 |
| Surface Tension @ 25° C. | | mN/m | 20.33 | 20.30 | 27.70 | 27.86 |
| Atmospheric Distillation Recovered Volume [%] | ASTM D86 | | | | | |
| 0 | | ° C. | 36.6 | 38.2 | 202.0 | 199.2 |
| 5 | | ° C. | 48.9 | 50.4 | 237.2 | 235.3 |
| 10 | | ° C. | 53.5 | 55.1 | 245.3 | 243.5 |
| 15 | | ° C. | 57.5 | 58.9 | 253.1 | 253.1 |
| 20 | | ° C. | 61.1 | 62.5 | 260.4 | 260.4 |
| 25 | | ° C. | 64.9 | 66.6 | 266.9 | 266.6 |
| 30 | | ° C. | 69.5 | 71.2 | 272.4 | 272.3 |
| 35 | | ° C. | 75.3 | 76.8 | 277.8 | 277.6 |
| 40 | | ° C. | 82.0 | 83.6 | 282.6 | 281.7 |
| 45 | | ° C. | 89.8 | 91.0 | 287.3 | 286.5 |
| 50 | | ° C. | 98.1 | 99.2 | 291.7 | 290.8 |
| 55 | | ° C. | 106.8 | 107.4 | 296.4 | 295.3 |
| 60 | | ° C. | 114.1 | 114.9 | 301.2 | 300.0 |
| 65 | | ° C. | 121.1 | 121.7 | 305.9 | 304.9 |
| 70 | | ° C. | 127.9 | 128.5 | 311.4 | 309.8 |
| 75 | | ° C. | 134.8 | 135.6 | 316.6 | 315.1 |
| 80 | | ° C. | 143.2 | 143.1 | 322.8 | 321.1 |
| 85 | | ° C. | 151.3 | 151.3 | 329.5 | 327.1 |
| 90 | | ° C. | 162.7 | 162.5 | 337.3 | 334.1 |
| 95 | | ° C. | 183.8 | 183.3 | 348.6 | 343.3 |
| FBP | | ° C. | 199.2 | 200.4 | 355.1 | 352.0 |
| FBP Vol % | | Vol % | 96.3 | 96.6 | 97.2 | 99.3 |
| Recovery | | Vol % | 96.8 | 97.2 | 98.0 | 100.0 |
| Residue | | Vol % | 0.0 | 0.0 | 0.1 | 0.0 |
| Loss | | Vol % | 3.2 | 2.8 | 1.9 | 0.0 |
| Total Recovery | | Vol % | 96.8 | 97.2 | 98.1 | 100.0 |
| Corrected Loss | | Vol % | 2.9 | 2.7 | 1.8 | 0.0 |
| Corrected Recovery | | Vol % | 97.1 | 97.3 | 98.1 | 100.0 |
| Corrected Total Recovery | | Vol % | 97.1 | 97.3 | 98.2 | 100.0 |

The composition of the present invention, when added to a liquid fuel, improves fuel efficiency and reduces emissions while keeping the fuel within all required standards. Without wishing to be bound by theory, it is believed that the additive forms a coating of the engine piston and combustion chamber that leads to an accelerated combustion rate and rapid flame propagation, thus reducing the ignition delay period and allowing complete combustion to take place.

The term "about" when preceding a numerical value throughout this specification refers to a range that is 10% more or less of the value.

It will be appreciated by persons skilled in the art that the present invention is not limited to what has been particularly shown and described hereinabove. Rather the scope of the present invention includes both combinations and subcombinations of various features described hereinabove as well as modifications thereof which would occur to a person of skill in the art upon reading the foregoing description and which are not in the prior art.

The invention claimed is:

1. A composition comprising:

water;

one or more mineral salts, wherein the one or more mineral salts are selected from alums;

a polyol compound;

an alcohol; and a surfactant.

2. The composition according to claim 1, wherein the water is demineralized water.

3. The composition according to claim 1, wherein the water is double distilled water.

4. The composition according to claim 1, wherein the alums are selected from the group consisting of sodium alum, potassium alum and ammonium alum.

5. The composition according to claim 1, wherein the one or more mineral salts is potassium alum or ammonium alum.

6. The composition according to claim 1, wherein the concentration of the one or more mineral salts in the composition is from about 0.5% w/w to about 5% w/w.

7. The composition according to claim 1, wherein the concentration of the one or more mineral salts in the composition is from about 2% w/w to about 2.5% w/w.

8. The composition according to claim 1, wherein the polyol compound is selected from the group consisting of glycols and glycerol.

9. The composition according to claim 8, wherein the glycols are selected from ethylene glycol and propylene glycol.

10. The composition according to claim 1, wherein the polyol compound is glycerol.

11. The composition according to claim 1, wherein the concentration of the polyol compound in the composition is from about 30% w/w to about 50% w/w.

12. The composition according to claim 1, wherein the concentration of the polyol compound in the composition is from about 40% w/w to about 50% w/w.

13. The composition according to claim 1, wherein the concentration of the polyol compound in the composition is about 45% w/w.

14. The composition according to claim 1, wherein the alcohol is a $C_1$-$C_5$ alcohol.

15. The composition according to claim 1, wherein the alcohol is a $C_1$-$C_3$ alcohol.

16. The composition according to claim 1, wherein the alcohol is propan-2-ol.

17. The composition according to claim 1, wherein the concentration of the alcohol in the composition is from about 5% w/w to about 15% w/w.

18. The composition according to claim 1, wherein the concentration of the alcohol in the composition is about 10% w/w.

19. The composition according to claim 1, wherein the surfactant is selected from the group consisting of alkyl glycosides and polysorbates.

20. The composition according to claim 19, wherein the alkyl glycosides are selected from the group consisting of decyl glycoside, lauryl glycoside and coco glycoside.

21. The composition according to claim 19, wherein the polysorbates are selected from the group consisting of polysorbate 20, polysorbate 40, polysorbate 60 and polysorbate 80.

22. The composition according to claim 1, wherein the surfactant is polysorbate 80.

23. The composition according to claim 1, wherein the concentration of the surfactant in the composition is from about 0.5% w/w to about 1.2% w/w.

24. The composition according to claim 1, wherein the concentration of the surfactant in the composition is about 1% w/w.

25. The composition according to claim 1, further comprising an agent for reducing formation of sludge.

26. The composition according to claim 25, wherein the agent for reducing formation of sludge is methyl oleate.

27. The composition according to claim 26, wherein the concentration of the methyl oleate in the composition is from about 1% w/w to about 50% w/w.

28. A method of preparing a composition useful as a fuel additive, the method comprising:

adding one or more mineral salts to water, wherein the one or more mineral salts are selected from alums;

heating the water with stirring until the mineral salts dissolve to form a solution;

removing the heating and adding a polyol compound with stirring to the warm solution;

adding an alcohol to the solution with stirring;

adding a surfactant to the solution with stirring; and allowing the solution to cool to room temperature.

29. The method of claim 28, wherein the composition is the composition of claim 1.

30. The method of claim 28, wherein the water is heated to a temperature of about 50° C. to about 80° C.

31. The method of claim 28, wherein the water is heated to a temperature of about 60° C. to about 70° C.

32. A blended fuel comprising:

a liquid fuel; and a composition according to claim 1.

33. The blended fuel of claim 32, wherein the liquid fuel is selected from the group consisting of gasoline, diesel, kerosene and mazut.

34. The blended fuel of claim 32, wherein the composition is added to the liquid fuel at a concentration of about 0.10% to about 0.2% w/w.

35. The blended fuel of claim 32, wherein the composition is added to the liquid fuel at a concentration of about 0.1% to about 0.15% w/w.

* * * * *